US006938545B2

(12) United States Patent
Fujii

(10) Patent No.: US 6,938,545 B2
(45) Date of Patent: Sep. 6, 2005

(54) SHEET-FED PRINTING PRESS

(75) Inventor: Yutaka Fujii, Fuchu (JP)

(73) Assignee: Ryobi, Ltd. (JP)

( * ) Notice: Subject to any disclaimer, the term of this patent is extended or adjusted under 35 U.S.C. 154(b) by 0 days.

(21) Appl. No.: 10/805,721

(22) Filed: Mar. 22, 2004

(65) Prior Publication Data

US 2004/0194650 A1 Oct. 7, 2004

(30) Foreign Application Priority Data

Apr. 3, 2003 (JP) ..... 2003-099892

(51) Int. Cl.[7] ..... B41F 13/24
(52) U.S. Cl. ..... 101/232; 101/174
(58) Field of Search ..... 101/232, 233, 101/174, 171, 216, 212, 365

(56) References Cited

U.S. PATENT DOCUMENTS 4,768,746 A * 9/1988 Rodi et al. ..... 248/447
5,031,534 A * 7/1991 Brunner ..... 101/365
5,377,587 A * 1/1995 Kobler ..... 101/233
5,705,020 A * 1/1998 Chiari ..... 156/350
5,829,525 A * 11/1998 Dobson et al. ..... 166/278
6,006,662 A * 12/1999 Ishida et al. ..... 101/141
6,343,548 B1 * 2/2002 Bayer et al. ..... 101/232
6,606,949 B1 * 8/2003 Funabashi ..... 101/491
6,715,417 B2 * 4/2004 Okuda ..... 101/181
6,748,860 B2 * 6/2004 Loffler et al. ..... 101/365
6,822,590 B2 * 11/2004 Kusaka ..... 341/104

FOREIGN PATENT DOCUMENTS

| | | |
|---|---|---|
| JP | 06-023960 | 7/1992 |
| JP | 06-031903 | 7/1992 |
| JP | 6-86940 | 5/1993 |
| JP | 2001-080050 | 9/1999 |

* cited by examiner

*Primary Examiner*—Anthony H. Nguyen
(74) *Attorney, Agent, or Firm*—Perkins Coie LLP

(57) ABSTRACT

A sheet-fed printing press includes a printing section for printing on sheets of paper, a sheet discharge section for discharging sheets of paper printed at the printing section from the printing section, a see-through part provided on the upper side of the sheet discharge section so that the inside of the sheet discharge section can be visually observed therethrough, and a color check table, on which a printed sheet of paper picked up from the sheet discharge section is placed for color checking thereof The color check table is located so as to at least partially cover the see-through part from above. The color check table is designed to be movable in a sheet transfer direction so that an area of the see-through part exposed to the outside on the downstream side of the color check table is increased as the color check table is moved towards an upstream side of the sheet transfer direction.

6 Claims, 7 Drawing Sheets

SHEET-FED PRINTING PRESS

CROSS REFERENCE TO RELATED APPLICATION

This application claims priority from Japanese Patent Application No. 2003-099892, which is incorporated herein by reference.

BACKGROUND OF THE INVENTION

1. Field of the Invention

The present invention relates to an improvement in a sheet-fed printing press equipped with a table for color checking of printed sheets.

2. Related Art

The sheet-fed printing press of the type is equipped with a table on which a printed sheet (printed matter) is placed for color checking thereof. This table will be hereinafter referred simply to a color check table. An operator picks up one of printed matters from a sheet discharge section and places the same on the color check table in order to compare the printed matter placed on the color check table with a reference printed matter (a color sample) to check registers, ink densities and so on. On the basis of the result of this checking, the amount of each ink is adjusted or corrected for example by controlling the opening degree of each ink fountain key.

The color check table for the above purpose is hitherto provided independently of a printing press body and therefore a space for the color check table must be separately provided. In order to omit the necessity to provide a separate space, Japanese Patent Application Laid-open No. 2001-80050 proposes an arrangement with the color check table disposed on the upper side of the sheet discharge section.

Although providing an advantage to omit the necessity to provide a separate space, the above arrangement with the color check table located on the upper side of the sheet discharge section does not allow a window to be provided on the upper side of the sheet discharge section. Or, the window is covered with the color check table provided on the upper side of the sheet discharge section. A window, which is provided on the upper side of the sheet discharge section to allow the operator to visually observe the ongoing sheet discharging process in printing operation, cannot be substantially used, if the color check table is located on the upper side of the sheet discharge section. The operator generally stands downstream to the printing press in order to perform his work such as adjusting the air supply to the sheet discharge section or checking whether stain or spot exists, while visually observing the ongoing sheet discharge process. Throughout the description, the terms, "upstream side" and "downstream side" are respectively used to represent a side closer to a sheet feed section and a side closer to a sheet discharge section with reference to the sheet transfer direction.

Accordingly, the sheet discharge section is provided with a window in order to check the ongoing sheet discharge process or check the quality of printed sheets upon visual observation of the inside of the sheet discharge section. In a case where the window is provided in a downstream sidewall of the sheet discharge section, the operator must frequently bend over to see the inside of the sheet discharge section through this window and also is hard to see the inside of the sheet discharge section through the window of the downstream sidewall. Therefore, it is preferable to solely provide the window on the upper side of the sheet discharge section or additionally provide another window on the upper side.

The arrangement with the window on the upper side of the sheet discharge section however poses the aforementioned problem. That is, the window is necessarily covered by the color check table disposed on the upper side of the sheet discharge section. In order to address this problem, the sheet discharge section may be designed to have a length large enough to accommodate both the color check table and the window respectively on the upstream side (a side closer to the printing press) and the downstream side thereto. This arrangement provides a high visual recognition capability, but poses a problem of deteriorating the operation efficiency in placing each printed sheet on the color check table. The reverse arrangement of the window and the color check table along the sheet transfer direction also poses a problem of deteriorating the visual recognition capability of the window.

In consideration of these problems, it is an object of the present invention to provide a sheet-fed printing press that is capable of securing a high visual recognition capability for the operator to observe the inside of the sheet discharge section, reducing the space for the color check table, as well as securing an excellent operation efficiency in placing each printed sheet on the color check table.

SUMMARY OF THE INVENTION

According to the present invention, there is provided a sheet-fed printing press, which includes a printing section for printing on sheets of paper, a sheet discharge section for discharging sheets of paper printed at the printing section from the printing section, a see-through part provided on the upper side of the sheet discharge section so that the inside of the sheet discharge section can be visually observed therethrough, and a color check table, on which a printed sheet of paper picked up from the sheet discharge section is placed for color checking thereof. The color check table is located so as to at least partially cover the see-through part from above. The color check table is designed to be movable in a sheet transfer direction so that an area of the see-through part exposed to the outside on the downstream side of the color check table is increased as the color check table is moved towards an upstream side of the sheet transfer direction.

During the operator performs the printing operation by using the thus arranged sheet-fed printing press, he generally stands downstream to the sheet discharge section. Accordingly, in the normal printing operation, the operator moves the color check table to the upstream side of the sheet transfer direction so that an area of the see-through part on the downstream side of the color check table is increased. With this positioning, the operator can easily make visual observation of the ongoing sheet discharge process through the see-through part exposed to the outside on the downstream side of the color check table, that is, a side closer to the operator. The color check table in this moment is located away from the operator.

When the color check table is to be used, the operator moves the color check table, which is located on the upstream side in the normal operation, downstream toward himself, and picks up a sheet discharged into the sheet discharge section from the printing section and then places the same on the color check table. Thus, the arrangement with the color check table located near the operator contributes to an improved efficiency in color checking operation by the operator. In this positioning of the color check table, the area of the see-through part exposed to the outside on the downstream side of the color check table is decreased.

Preferably, an ink-amount controller for adjusting the amount of ink and a main controller for controlling the operation of the printing press are provided on the upper side of the sheet discharge section, in which the ink-amount controller is moved along with the color check table, and the main controller is fixed in position independently of the color check table. While the ink-amount controller is used particularly during the color check table is in use, the main controller is constantly used during the operation of the printing press. Accordingly, it is preferable to employ an arrangement allowing the ink-amount controller to be moved along with the color check table, while the main controller is constantly held at a certain position on the upper side of the sheet discharge section.

Preferably, the main controller is fixed along a downstream end on the upper side of the sheet discharge section so that when the color check table has been moved to a most downstream position, the ink-amount controller is positioned along the downstream end on the upper side of the discharge section so as to be substantially aligned with the main controller. The alignment of the main controller and the ink-amount controller alongside the downstream end of the sheet discharge section allows for ease of operation and particularly allows for prompt action to deal with trouble or the like even during the operation of the ink-amount controller by operating the adjacent main controller.

The sheet-fed printing press preferably further includes a lock mechanism for locking the color check table to the most downstream position, in which the lock mechanism is designed to release the color check table from a locked position thereof upon operation of a release member. The operator tends to lean against the color check table during the color checking operation is made for a printed sheet placed on the color check table that is held at the most downstream position. The lock mechanism, which securely locks the color check table to the most downstream position and does not release the same from its locked position unless the release member is operated, prevents unintentional movement of the color check table towards the upstream side by the outside force or the like during the color checking operation and hence allows the operator to perform his work without special care on this unintentional movement.

BRIEF DESCRIPTION OF THE DRAWINGS

The above, and other objects, features and advantages of the present invention will become apparent from the detailed description thereof in conjunction with the accompanying drawings wherein.

FIGS. 2A and 2B are respectively side elevational views of an essential portion in proximity to a sheet discharge section of the printing press, in which FIG. 2A illustrates the color check table held at the most downstream position and FIG. 2B illustrates the color check table held at the most upstream position.

FIGS. 3A and 3B are respectively top plan views of an essential portion in proximity to the sheet discharge section of the printing press, in which FIG. 3A illustrates a view corresponding to FIG. 2A and FIG. 3B illustrates a view corresponding to FIG. 2B.

DESCRIPTION OF THE PREFERRED EMBODIMENTS

An embodiment of the sheet-fed printing press according to the present invention will be herein described with reference to the drawings attached hereto.

Figure 1:
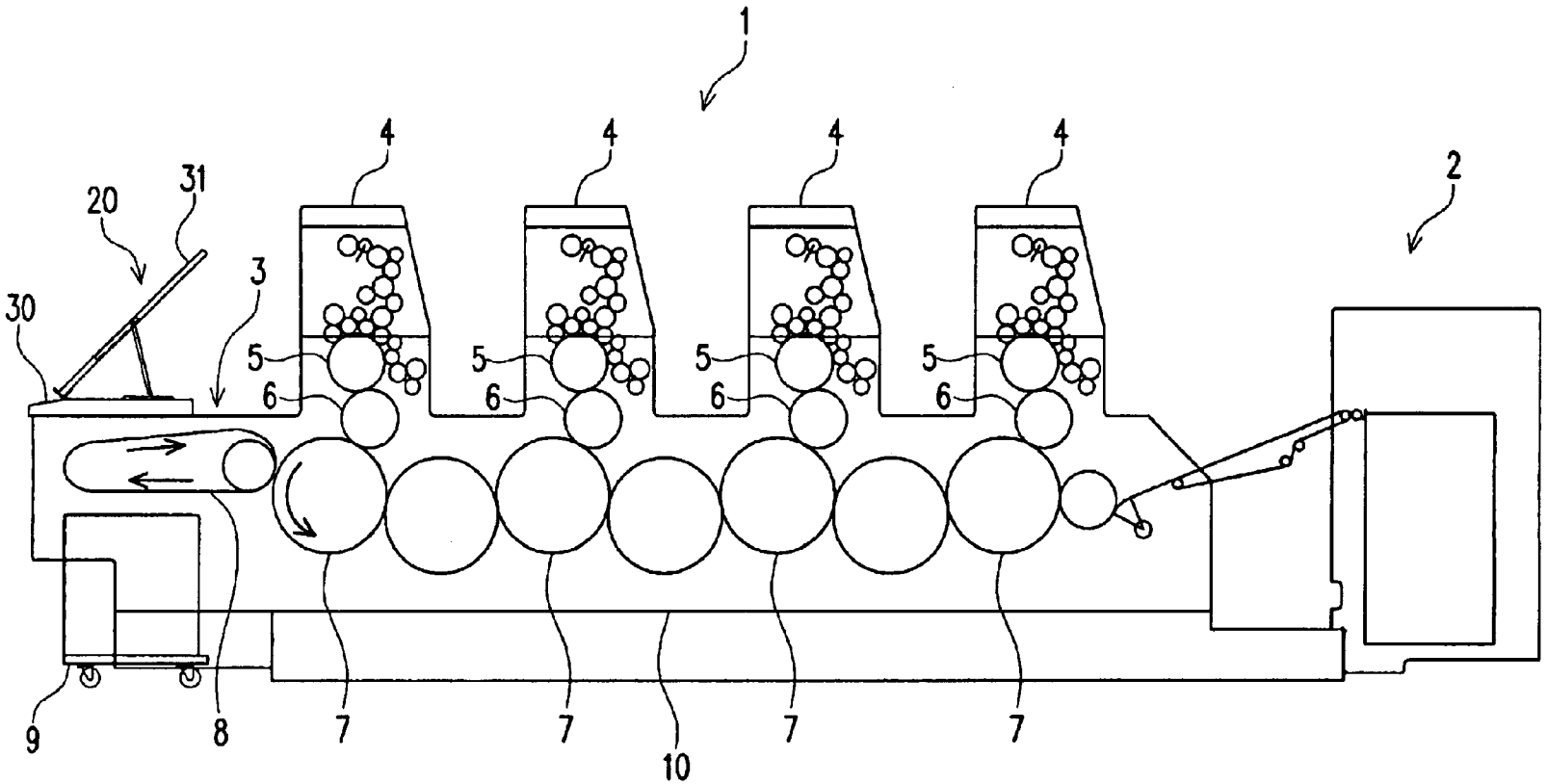
FIG. 1 is a schematic side elevational view of a sheet-fed printing press according to one embodiment of the present invention.

The sheet-fed printing press as illustrated in FIG. 1 includes a printing section 1 that performs a sheet printing operation, a sheet feed section 2 that feeds sheets of paper (hereinafter simply referred to sheets) to the printing section 1 and a sheet discharge section 3 that receives sheets printed at the printing section 1 and stacks them together therein.

The printing section 1 includes plural printing units 4. Specifically, the printing press of this embodiment is a multi-color printing press with the printing units aligned from the upstream side to the downstream side in the sheet transfer direction. The printing units 4 each include a plate cylinder 5, a blanket cylinder 6 and an impression cylinder 7 so that each printing unit 4 prints one color on sheets. In an arrangement illustrated in FIG. 1, a total of four printing units 4 are provided so as to perform a four-color printing, while the number of the printing units 4, the cylinder arrangement or the like are not necessarily limited to this embodiment and therefore may be modified or varied.

Sheets (printed matters) printed at the printing section 1 are transferred from the impression cylinder 7 of the most downstream printing unit 4, that is, the fourth printing unit 4, to an endless, sheet discharge chain 8. The sheet discharge chain 8 includes grippers (not shown) at a spacing to each other, in which the grippers successively receive oncoming sheets from the impression cylinder 7. Thus, printed sheets are transferred downstream along with the rotational motion of the sheet discharge chain 8 and then stacked together on a discharged sheet table 9.

Figure 2A:
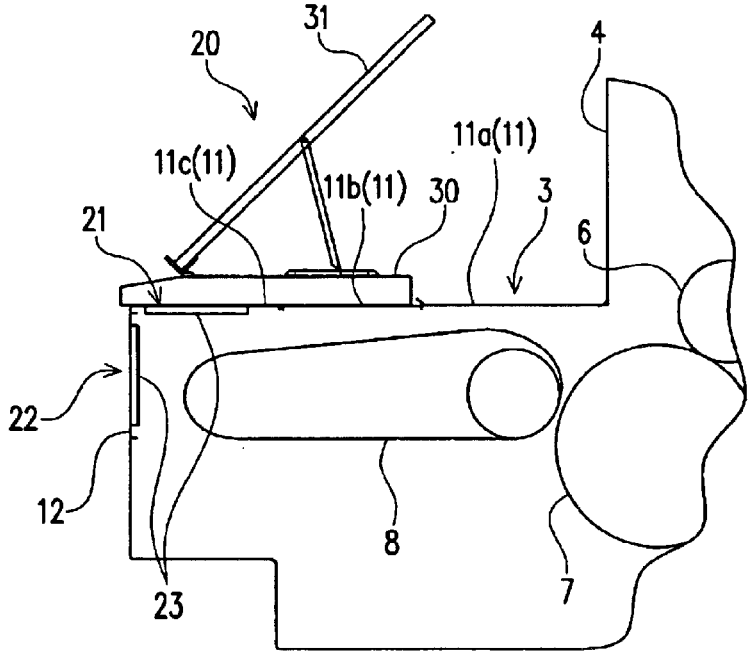
Figure 2B:
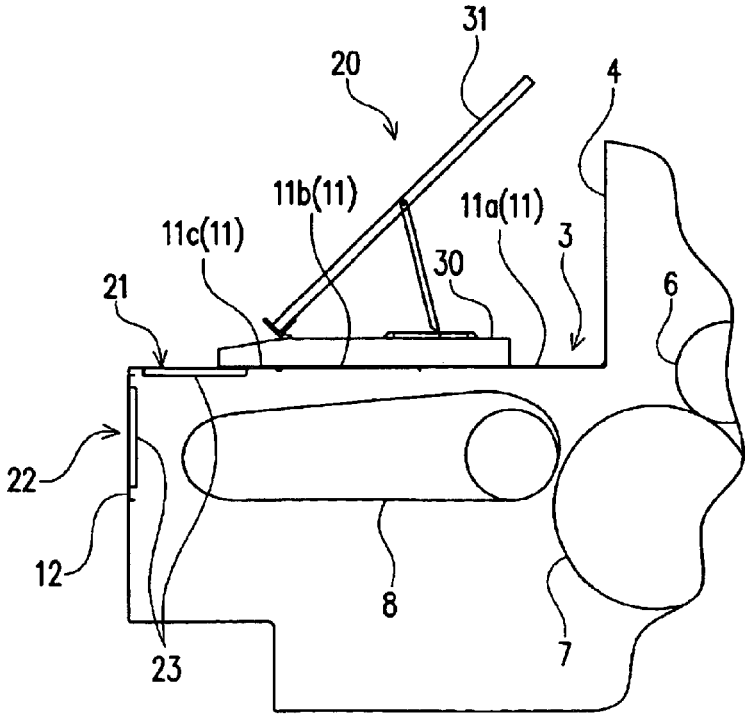

On the upper side of the sheet discharge section 3 is disposed a color check table 20 on which printed matters are placed for color checking. FIG. 2 represent a model view of the sheet discharge section 3, in which the color check table 20 is linearly movable within a predetermined distance in the sheet transfer direction. Specifically, FIG. 2A illustrates the color check table 20 held at the most downstream position within the movable range, and FIG. 2B illustrates the color check table 20 held at the most upstream position within the movable range. That is, the color check table 20 is capable of taking a position closer to the printing section 1 (FIG. 2B) and a position away from the printing section 1 (FIG. 2A). At the most downstream position, which is farthest from the printing section 1, the color check table 20 is positioned at a downstream end of the sheet discharge section 3 or printing press.

The cylinders 5, 6, 7 and the sheet discharge chain 8 are all disposed between the laterally opposite sidewalls of a frame 10 and rotatably supported thereto. The sheet discharge section 3 has an upper wall and a back wall (a downstream-sidewall), on which protective plates 11, 12 are respectively disposed so as to extend between the opposite sidewalls of the frame 10. Thus, the sheet discharge chain 8 is surrounded on all four sides except for the bottom and front (upstream) sides by the opposite sidewalls of the frame 10, the upper protective plate 11 and the back protective plate 12.

The opposite sidewalls of the frame 10 as well as the protective plates 11, 12 are so constructed as to obstacle vision of the inside of the sheet discharge section 3. In order to check the ongoing sheet discharging operation of the chain 8, the upper protective plate 11 and the back protective plate 12 respectively have windows (see-through parts) 21, 22, which are respectively formed in the upper protective plate 11 on the downstream side thereof and in the back protective plate 12 on the upper side thereof so as to allow the operator to visually observe the inside of the sheet discharge section 3 therethrough. Accordingly, the inside of the sheet discharge section 3 cannot be visually observed at least from right above or obliquely above through a region except for the windows 21, 22. The window 21 of the upper protective plate 11 is located substantially above the discharged sheet table 9. Openings, partly cut out of the protective plates 11, 12 may serve s the windows 21, 22. In this arrangement, a transparent member is preferably mounted in each window. As the transparent member, acrylic plate or any other transparent synthetic resin plate, reinforced glass or the like is preferably used.

Figure 7:
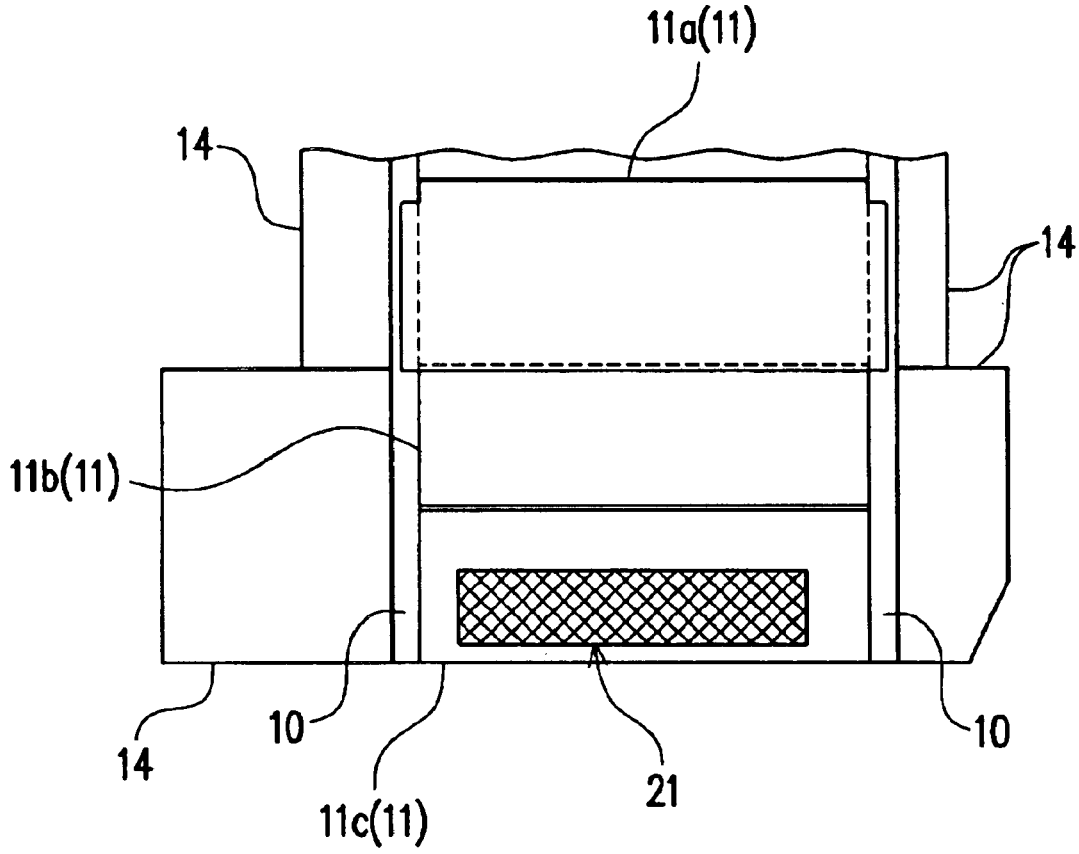
FIG. 7 is a top plan view of a portion in proximity to the sheet discharge section of a conventional sheet-fed printing press, which view corresponding to FIGS. 3A and 3B.

FIG. 7 is a top plan view of an essential portion of the conventional printing press with the sheet discharge section 3 equipped with no color check table 20. This conventional printing press is identical in arrangement to the printing press of this embodiment, except for the color check table 20. As illustrated in FIG. 7, a total of three upper protective plates 11 are successively mounted from the upstream side to the downstream side, in which an upstream upper protective plate 11*a* is arranged to be pivotally moved upward about an upstream end portion thereof, while center and downstream upper protective plates 11*b*, 11*c* are secured to the opposite sidewalls of the frame 10 with screws. As illustrated in chain double-dashed line of FIG. 5, the upper protective plate 11 is set substantially in flush with top end surfaces of the opposite sidewalls of the frame 10 and mounted to the inner surfaces of the opposite sidewalls of the frame 10 via brackets 13. The window 21 with a transparent plate 23 such as an acrylic plate fitted therein, is located substantially in the center portion of the downstream upper protective plate 11*c*. In FIG. 7, the window 21 is illustrated in cross hatching, and a portion thereof exposed to the outside is also illustrated in cross hatching in FIG. 3B (hereinafter referred).

Drive gears and other members or parts for driving the cylinders and the like are disposed outside of the frame 10 and covered with protective covers 14. For this, the protective covers 14 extend laterally outside from the opposite sidewalls of the frame 10.

Figure 3B:
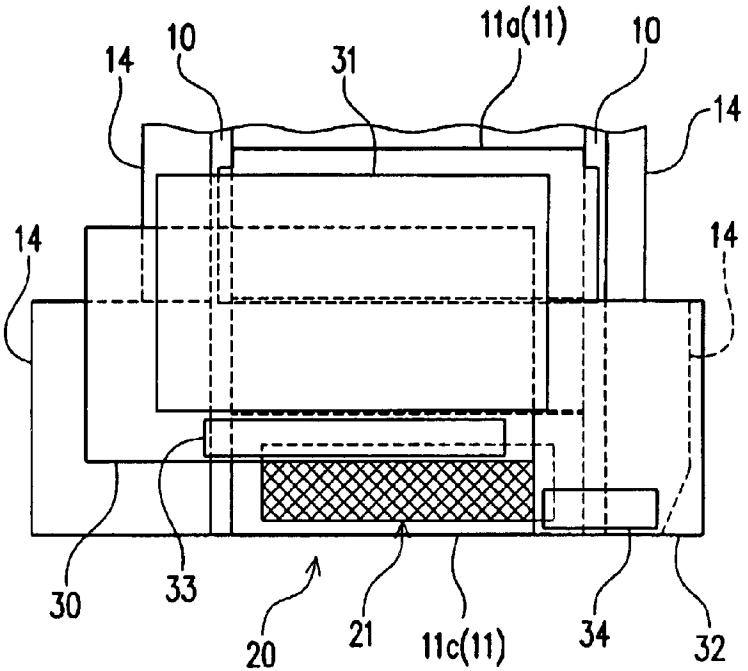
Figure 3A:
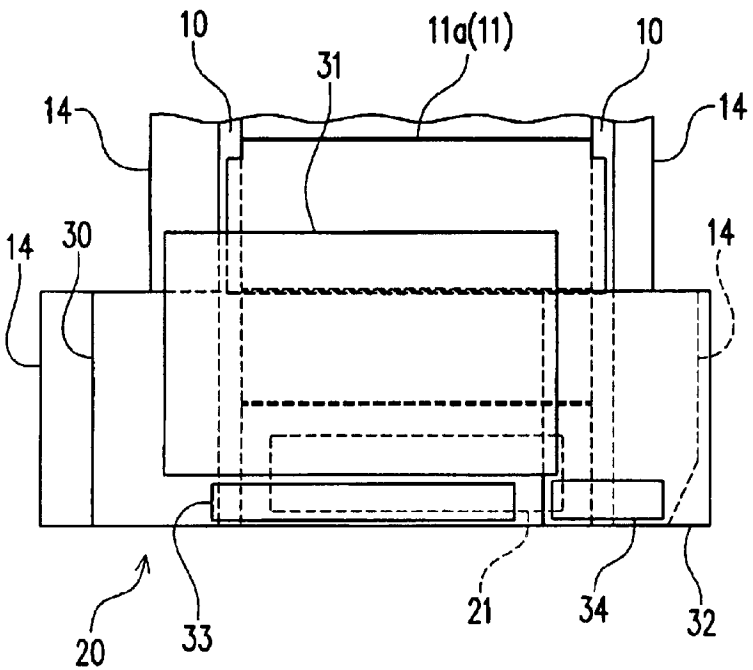

Referring back to FIGS. 2A and 2B, the color check table 20 is movably mounted on the upper side of the sheet discharge section 3 within a predetermined distance in the sheet transfer direction, in which the color check table 20 covers entirely the window from above when it is moved to the most downstream position. As the color check table 20 is moved from the most downstream position towards the upstream side, the window 21 is gradually exposed to the outside from its downstream side. Then, with the color check table 20 held at the most upstream position within the movable range, around half or more than half of the window on the downstream side thereof is exposed to the outside, as illustrated in FIG. 2B. In other words, as the color check table 20 is moved closer to the printing section 1, an area of the window 21 covered by the color check table 20 is gradually reduced. FIGS. 3A and 3B illustrate such a positional relationship between the color check table 20 and the window 21 as observed from above, in which the window 21 is entirely covered by the color check table 20 at the most downstream position (FIG. 3A) and partially exposed to the outside at the most upstream position (FIG. 3B).

Now, the description will be made in detail for the structure of the color check table 20 and a structure that makes the color check table 20 movable in the sheet transfer direction.

Figure 4:
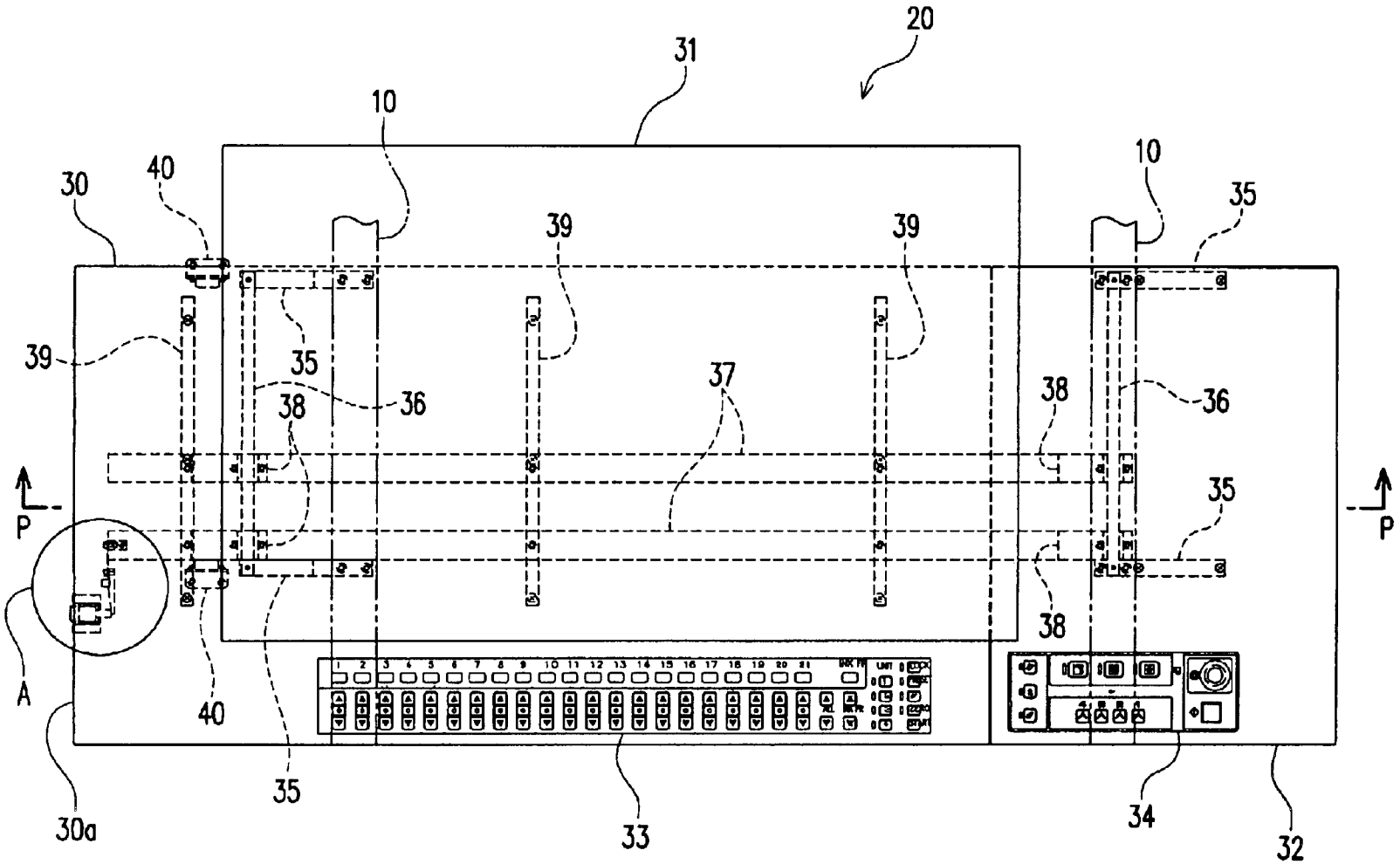
FIG. 4 is a top plan view of an essential portion in proximity to the sheet discharge section of the printing press.

As illustrated in FIGS. 2–4, the color check table 20 includes a base 30 that is mounted on the upper side of the sheet discharge section 3 so as to be able to be linearly moved in the sheet transfer direction, and a printed-matter mounting board 31 that is attached on the base 30. The base 30 is disposed, as partially covering or overlapping the window 21 from above, so that, when the mounting board 31 and the base 30 are integrally moved towards the upstream side, a certain area of the window 21 on the downstream side thereof is exposed to the outside, as illustrated in FIG. 3B. A main control box 32 is located on a side (a right side in FIG. 3) of the base 30. This main control box 32 also partially covers or overlaps the window 21, which covered or overlapped area being smaller than the area covered or overlapped by the base 30. In this regard, it is a matter of course to employ an arrangement allowing the main control box 32 not to cover or overlap the window 21.

The mounting board 31 is downwardly slanted from its upstream end to the downstream end at an angle, which angle may be varied depending on each operation. An ink-amount controller 33 for adjusting the amount of ink for each ink fountain key is mounted on the base 30 along the downstream end thereof, as illustrated in FIG. 4. The ink-amount controller 33 has switch buttons aligned in the lateral direction corresponding in position to ink fountain keys so as to each increase or decrease the amount of ink for a corresponding ink fountain key. A main controller 34 for controlling start and stop the printing press is disposed on the main control box 32 along the downstream end thereof, and has switch buttons for selectively starting and stopping the respective parts or members of the printing press. That is, the main controller 34 is fixedly disposed on the upper side of the sheet discharge section 3 along the downstream end, while the ink-amount controller 33, which is also disposed on the upper side of the sheet discharge section 3, is brought into alignment with the main controller 34 in the lateral direction when the color check table 20 is held at the most downstream position.

Figure 5:
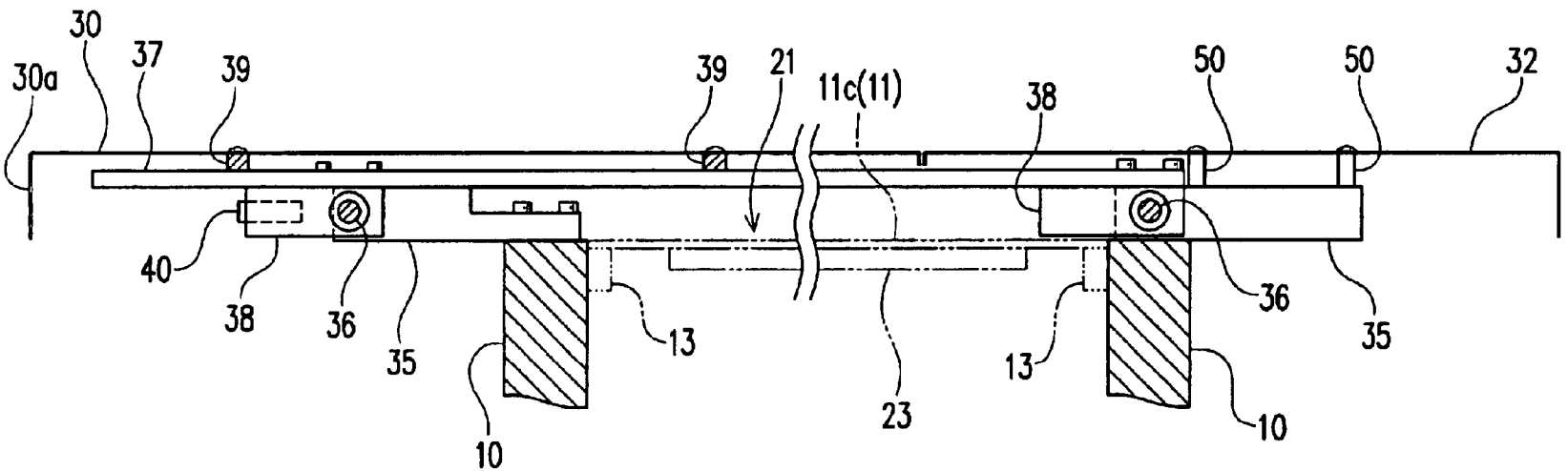
FIG. 5 is a cross sectional view taken along a line P—P in FIG. 4.

The base 30 is mounted by following the steps as mentioned below. As illustrated in FIGS. 4 and 5, support brackets 35 are secured to the upper ends of the opposite sidewalls of the frame 10 with screws. In FIG. 5, the mounting board 31 is omitted. A pair of the support brackets 35 (an upstream support bracket and a downstream support bracket) are mounted on each sidewall of the frame 10 with a predetermined distance to each other, as illustrated in FIG. 4. A rounded rod-like guide rail 36 is secured to the upstream and downstream support brackets 35 on each sidewall of the frame 10. The thus secured guide rails 36 extend parallel to each other in the sheet transfer direction. Connection bars 37 are sidably mounted to the guide rails 36 for connection therebetween via bearings 38. A total of two connection bars 37 are disposed respectively on the upstream side and the downstream side in this embodiment, as illustrated in FIG. 4. The upstream and downstream support brackets 35 on each sidewall of the frame 10 fixedly support each guide rail 36 through its opposite ends. The two connection bars 37 are located between each pair of the support brackets 35.

The two connection bars 37 are connected to each other with reinforcing bars 39 that extend in the sheet transfer direction. A total of three reinforcing bars 39 are located parallel to each other with a predetermined distance therebetween along a direction orthogonal to the sheet transfer direction (i.e., the lateral direction). The base 30 is secured to the reinforcing bars 39 with screws so as to be sidably supported on the guide rails 36 via the connection bars 37 and the reinforcing bars 39. Thus, the color check table 20 is movable in the sheet transfer direction on the upper side of the sheet discharge section.

The main control box 32, which is located on the upper side of the frame 10, is secured via studs 50 to the upstream and downstream support brackets 35 with screws and hence secured to the frame 10.

The color check table 20, which is sidable in the sheet transfer direction, is provided with a retaining member that retains the color check table 20 to the most upstream position and the most downstream position with a predetermined retaining force and releases the same from a retained state when a force exceeding the predetermined retaining force acts on the color check table 20. Specifically, as the retaining member, a pair of magnets (upstream and downstream magnets) 40, which are fixed in position, are employed in this embodiment. The magnets 40 are secured to the frame 10 via fitting members (not shown), as illustrated in FIG. 4, so as to each attract a corresponding connection bar 37 and hold the same in position. When the downstream connection bar 37 is attracted and held by the downstream magnet 40 at the most downstream position, the window 21 is kept entirely covered by the color check table 20, as illustrated in FIG. 3A. When the upstream connection bar 37 is attracted and held by the upstream magnet 40 at the most upstream position, a certain area of the window 21 on the downstream side is kept exposed to the outside, as illustrated in FIG. 3B. The upstream and downstream magnets 40 are to be substantially equal in magnetic force to each other in this embodiment, but are possible to be set to be different from each other.

Figure 6B:
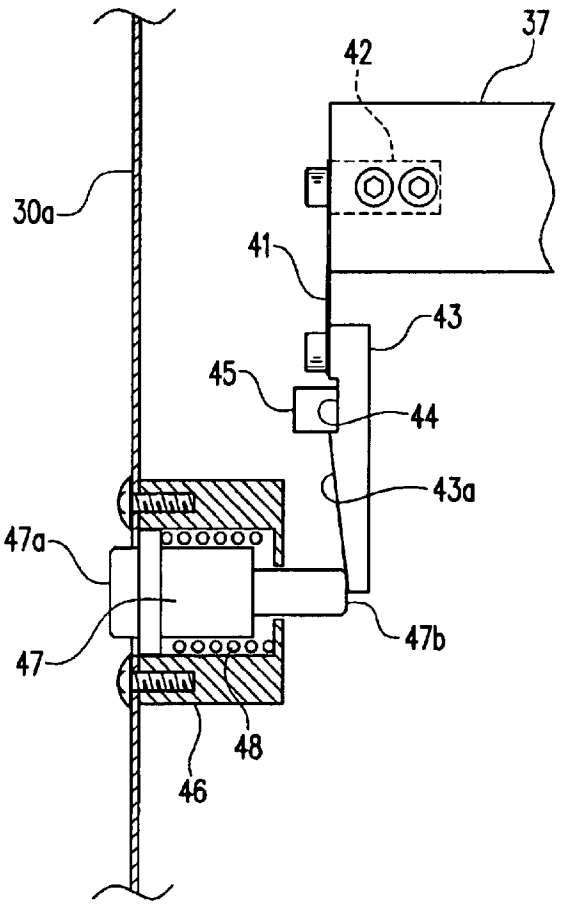
FIGS. 6A and 6B are respectively a side view and a cross sectional view of an "A" portion of FIG. 4.
Figure 6A:
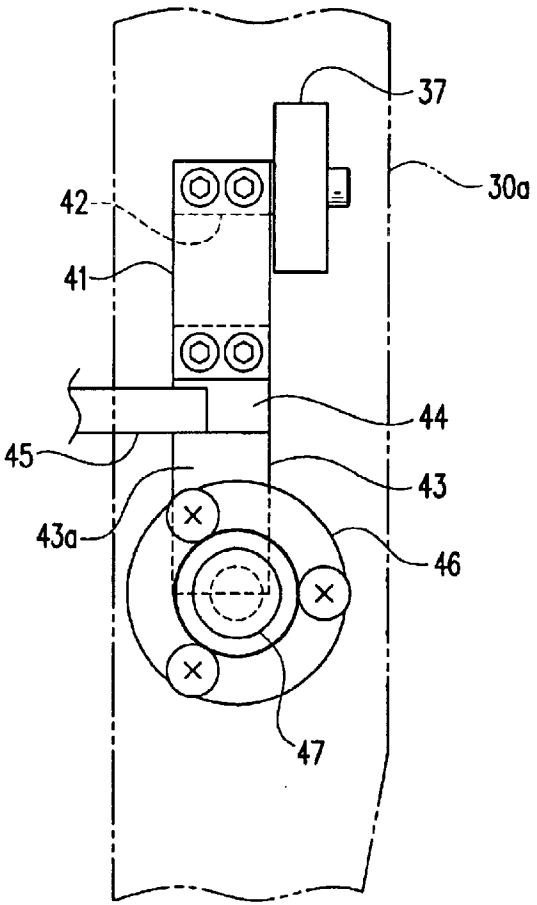

In this embodiment, a lock mechanism is provided to lock the color check table 20 to the most downstream position. The lock mechanism includes a stopper receiving part provided on the color check table 20, a stopper provided on the frame 10 so as to engage with the stopper receiving part at the most downstream position, thereby bringing the color check table 20 into a locked state, and a release member adapted to release the stopper receiving part from the engaged state with the stopper and hence release the color check table 20 from the locked state. Specifically, as illustrated in FIGS. 6A and 6B, a blade spring 41 is mounted on an end of the connection bar 37 (the downstream connection bar in this embodiment) via a fitting member 42. The blade spring 41 is mounted so as to be elastically deformable or bendable in the lateral direction (a direction orthogonal to the sheet transfer direction), and a lock claw 43 as the stopper receiving part is mounted on a downstream end of the blade spring 41. The lock claw 43 extends downstream from its proximal end, that is, from the upstream end thereof and has a vertical engagement groove 44 formed on its lateral side at a certain point in the sheet transfer direction. On the other hand, an engagement pin 45 as the stopper is secured to the frame 10 so that when the engagement pin 45 is engaged with the engagement groove 44, the lock claw 43 is locked in position with the engagement pin 45. A frame 46 is secured to a sidewall 30*a* with screws so as to support a release pin 47 as the release member in a laterally movable manner. The release pin 47 extends through the sidewall 30*a* to have a first end 47*a* located outside of the sidewall 30*a*. The release pin 47 is operated by pressing the first end 47*a* towards the inside of the frame 46 by the operator. The release pin 47 is urged outward by a spring 48. Accordingly, when the release pin 47 is inwardly pressed against an urging force of the spring 48, a second end 47*b* of the release pin 47 presses the downstream end of the lock claw 43, thereby elastically deforming or bending the blade spring 41 and hence releasing the lock claw 43 from its locked position. While FIG. 6B illustrates the release pin 47 and the lock claw 43 in abutment with each other, they may be held with a space to each other. While the lock claw 43 as illustrated is tapered towards the downstream end, it may of a flat shape with a uniform thickness along its lengthwise axis. In addition, various modifications may be applied to this lock mechanism, although the lock claw 43 with a tapered surface 43*a* allows the engagement pin 45 held in a fixed state to be smoothly guided along the tapered surface 43*a* into the engagement groove 44 when the color check table 20 is moved downstream.

According to the thus arranged printing press, the color check table 20 is held at the most upstream position in the normal printing operation by the attracting force of the magnet 40, as illustrated in FIGS. 2B and 3B. The operator, who performs the work as standing downstream to the sheet discharge section 3, can visually observe the ongoing sheet discharging process of the sheet discharge chain 8 through the window 21 located on the upper side of the sheet discharge section 3. If a trouble occurs in sheet discharging process, a proper measure such as stopping sheet feeding operation can be promptly taken such as by the operation of the main controller 34 upon visual observation through the window 21. While the main control box 32 may be designed to be movable integrally with the color check table 20, it is preferably fixed in position in such a manner as described in this embodiment for dealing with such a trouble in prompt manner. As illustrated in FIG. 3A, with the color check table 20 held at the most downstream position, the ink-amount controller 33 is substantially aligned with the main controller 34 in the lateral direction. This aligned arrangement allows the operator to easily and promptly reach the main controller 34 located next to the ink-amount controller 33, thereby achieving prompt dealing with trouble even during the operation of the ink-amount controller 33 in the printing press.

When the color checking is to be made by taking out one of printed matters from the sheet discharge section 3, the color check table 20 held at the most upstream position is drawn downstream or closer to the operator. Once the color check table 20 has reached the most downstream position, it is held by the attraction force of the magnet 40 and locked in position by the engagement of the engagement pin 45 with the lock claw 43. Since the lock claw 43 is not released from its locked position unless the release pin 47 is pressed by the operator, the operator can easily check the color or the like of a printed matter mounted on the securely supported mounting board 31. In addition, the ink-amount controller 33 is provided on the color check table 20, it is also held at the downstream end of the sheet discharge section 3, near the operator, it is easy for the operator to adjust the amount of each ink by the operation of the ink-amount controller 33.

Once the color checking operation is finished, the lock claw 43 is released from its locked position by pressing the release pin 47. The color check table 20 thus released from its locked position is pushed towards the upstream side, thereby causing the downstream connection bar 37 to be moved away from the magnet 40 against the attraction force of the downstream magnet 40. The color check table 20 slid towards the upstream side is then attracted and held by the upstream magnet 40 at the most upstream position.

Thus, during the normal printing operation, in which the color check table 20 is retracted to the most upstream position, visual observation of the inside of the sheet discharge section is made from above through the window 21 exposed to the outside. Although the window 22 is also formed in the back protective plate 12, the operator is hard to achieve visual observation through this window unless he bends over the back protective plate 12. Contrarily to this, the visual observation through the window 21 allows the operator to reduce his workload since he does not need to bend over. Since the ink-amount controller 33 is also retracted to the upstream side away from the operator during this normal printing operation, it is possible to avoid mistouch input or unintentional operation of the ink-amount controller 33.

Also, with the color check table 20 moved to the downstream side, the space between each printing unit 4 and the color check table 20 is widened so that a printing plate can be mounted on the plate cylinder of each printing unit 4 via this space.

This embodiment has been described by taking for example the case where the window 21 is entirely covered when the color check table 20 is held at the most upstream position. In this regard, various arrangements may be employed as long as the window 21 is at least partially covered. It is also possible to employ an arrangement that allows the window 21 to be entirely exposed to the outside as the color check table 20 is moved to the upstream side. In other words, any arrangement is possible as long as the area of the window 21 covered by the color check table 20 is decreased, or the exposed area of the window 21 on the downstream side of the color check table 20 is increased by moving the color check table 20 to the upstream side of the sheet transfer direction. Accordingly, it is possible to employ an arrangement where the length of the window 21 in the sheet transfer direction is greater than the moving stroke of the color check table 20, or an arrangement where the window 21 is formed throughout substantially the entire length of the upper side of the sheet discharge section 3 in the sheet transfer direction. Any arrangement may be employed, as long as the exposed area of the window 21 on the downstream side of the color check table 20 is increased by the movement of the color check table 20 towards the upstream side. While this embodiment has been described by taking for example the case where the window 21 is solely provided substantially in the center portion of the downstream upper protective plate 11*c* so as to serve as the see-through part, two or more windows may be provided on the upper side of the sheet discharge section 3. Also, the window 21 may be provided in any position on the upper side of the sheet discharge section 3. It is possible to employ the upper protective plate 11 made of a transparent material, allowing the plate 11 itself to serve as the see-through part. In this case, the upper protective plate 11 may be made of a mesh material such as a wire sheet, or a material having a number of punch holes so as to allow visual observation therethrough. Further, the see-through part may be provided by the arrangement where the upper protective plate 11 is not provided so as to partly or entirely expose the upper side of the sheet discharge section to the outside.

The color check table 20 may be provided with a scanner or other devices.

In the above description, the lock claw 43 is mounted to the color check table 20 in a movable manner and the engagement pin is secured to the frame 10. This arrangement may be reversed. That is, a stopper or engagement pin is secured to the color check table 20, while a stopper receiving part or lock claw is mounted to the frame 10 in a movable manner. In either arrangement, it is preferable to make the stopper receiving part or lock claw movable in a direction orthogonal to the sheet transfer direction and provide an urging means for urging the stopper receiving part or lock claw towards a stand-by position when the lock claw has been moved from the stand-by position in the direction orthogonal to the sheet transfer direction towards the engagement position, so that the movement of the color check table 20 allows the stopper receiving part or lock claw to be moved from the stand-by position in the direction orthogonal to the sheet transfer direction by a predetermined distance and abut against the stopper or engagement pin in the direction orthogonal to the sheet transfer direction. In this case, the direction in which a release member or release pin is operated or pressed in the direction orthogonal to the sheet transfer direction. This arrangement allows the operator to prevent unintentional operation or pressing of the release member or release pin even, which may occur such as in a case where the operator leans against the sheet discharge section 3 from the downstream side thereto. Thus, the operator can perform his work without special care on such unintentional operation.

With the thus arranged sheet-fed printing press equipped with the color check table that is located on the upper side of the sheet discharge section, less space is required for the equipment of the color check table. Further, the movement of the color check table towards the upstream side of the sheet transfer direction secures a better visual observation through the see-through part, while the movement of the color check table towards the downstream side of the sheet transfer direction allows the color check table to be located closer to the operator who places a printed matter or sheet on the color check table, thus reducing the workload of the operator and achieving improved operation efficiency.

This specification is by no means intended to restrict the present invention to the preferred embodiments set forth therein. Various modifications to the sheet-fed printing press, as described herein, may be made by those skilled in the art without departing from the spirit and scope of the present invention as defined in the appended claims.

What is claimed is:

1. A sheet-fed printing press comprising;

a printing section for printing on sheets of paper;

a sheet discharge section for discharging sheets of paper printed at said printing section from said printing section;

a see-through part provided on the upper side of the sheet discharge section so that the inside of said sheet discharge section can be visually observed therethrough;

a color check table, on which a printed sheet of paper picked up from said sheet discharge section is placed for color checking thereof, said color check table being located so as to at least partially cover said see-through part from above; and said color check table being designed to be movable in a sheet transfer direction so that an area of said see-through part exposed to the outside on the downstream side of said color check table is increased as said color check table is moved towards an upstream side of the sheet transfer direction.

2. The sheet-fed printing press according to claim 1, wherein:

an ink-amount controller for adjusting the amount of ink and a main controller for controlling the operation of the printing press are provided on the upper side of said sheet discharge section;

said ink-amount controller is moved along with said color check table; and said main controller is fixed in position independently of said color check table.

3. The sheet-fed printing press according to claim 2, wherein said main controller is fixed along a downstream end on the upper side of said sheet discharge section so that when said color check table has been moved to a most downstream side, said ink-amount controller is positioned along said downstream end on the upper side of said discharge section so as to be substantially aligned with said main controller.

4. The sheet-fed printing press according to claim 1, further comprising a lock mechanism for locking said color check table to said most downstream side, said lock mechanism being designed to release said color check table from a locked position thereof upon operation of a release member.

5. The sheet-fed printing press according to claim 2, further comprising a lock mechanism for locking said color check table to said most downstream side, said lock mechanism being designed to release said color check table from a locked position thereof upon operation of a release member.

6. The sheet-fed printing press according to claim 3, further comprising a lock mechanism for locking said color check table to said most downstream side, said lock mechanism being designed to release said color check table from a locked position thereof upon operation of a release member.

* * * * *